US006145443A

United States Patent [19]

Gabriel et al.

[11] Patent Number: 6,145,443

[45] Date of Patent: Nov. 14, 2000

[54] SUSPENSION FOR SUSPENDING A RUNNING RAIL OF A LIFTING MECHANISM FROM A GIRDER

[75] Inventors: Klaus-Dieter Gabriel, Hagen; Klaus Enners, Wuppertal, both of Germany

[73] Assignee: Mannesmann AG, Düsseldorf, Germany

[21] Appl. No.: 09/102,505

[22] Filed: Jun. 22, 1998

[30] Foreign Application Priority Data

Jun. 24, 1997 [DE] Germany ..... 197 27 836

[51] Int. Cl.[7] ..... B61B 3/00

[52] U.S. Cl. ..... 104/89; 104/93; 24/115 R; 403/211; 403/374.1; 403/409.1

[58] Field of Search ..... 104/89, 93; 24/115 R; 403/209, 210, 211, 374.1, 409.1

[56] References Cited

U.S. PATENT DOCUMENTS

| | | | |
|---|---|---|---|
| 1,071,868 | 9/1913 | Blackburn | 403/211 |
| 1,380,800 | 6/1921 | Haworth | 403/211 |
| 1,622,109 | 3/1927 | Haworth | 403/112 |
| 1,622,110 | 3/1927 | Haworth | 403/211 |
| 1,644,375 | 10/1927 | Haworth | 403/211 |
| 1,644,376 | 10/1927 | Haworth | 403/211 |
| 1,850,896 | 3/1932 | Roe | 403/211 |
| 1,955,450 | 4/1934 | Blackburn | 24/126 |
| 2,541,425 | 2/1951 | Kunnas | 403/211 |
| 3,766,610 | 10/1973 | Thorsbakken | 403/211 |
| 3,906,865 | 9/1975 | Pamer | 104/89 |
| 4,718,788 | 1/1988 | Briscoe | 403/211 |
| 4,809,408 | 3/1989 | Abrahamson | 403/211 |

FOREIGN PATENT DOCUMENTS

| | | | |
|---|---|---|---|
| 775474 | 12/1934 | France | 5/3 |
| 315765 | 7/1927 | United Kingdom . | |

OTHER PUBLICATIONS

DEMAG Material Handling Equipment, KBK Secondary Restraints Installation Sheet shows a prior art secondary restraint including a cable loop, wherein ends of the cable loop are connected by interlcoking eye pieces.

*Primary Examiner*—S. Joseph Morano
*Assistant Examiner*—Lars A. Olson
*Attorney, Agent, or Firm*—Cohen, Pontani, Lieberman & Pavane

[57] ABSTRACT

The invention is directed to a suspension for the running rail of a lifting mechanism at a girder, with a cable connecting the girder and the running rail. The ends of the cable are detachably connected with one another by a connection element. To prevent tearing of the redundant suspension or to prevent the cable clamps from damaging the cables in the event of sudden loading, for example, if the primary running rail fastening system tears or breaks, the connection element formed of two wedge locks connected to one another are arranged in such a way that one wedge lock is rotated by 180 degrees relative to the other wedge lock. Accordingly, the working directions of the wedges clamping the ends of the cable are oppositely directed. The ends of the cable which run in from opposite directions can be guided back in the direction opposite to their running-in direction after deflection around the wedges of the wedge locks such that they can be clamped by the wedges, at least under load.

4 Claims, 3 Drawing Sheets

SUSPENSION FOR SUSPENDING A RUNNING RAIL OF A LIFTING MECHANISM FROM A GIRDER

BACKGROUND OF THE INVENTION

1. Field of the Invention

The invention is directed to a suspension for suspending a running rail of a lifting mechanism from a girder.

2. Description of the Related Art

A brochure by Demag Material Handling Equipment ("KBK Secondary Restraints Installation Sheets") discloses a redundant suspension for running rails (craneways and monorails) in which the running rail is additionally secured by a steel cable. It is the task of the redundant suspension to take over the supporting function in the event of failure of the primary suspension means which is usually formed by a screw connection. For this purpose, a steel cable is looped around an upper girder and guided through an opening of a carrying element that is additionally fastened to the running rail. The ends of the cable are constructed as cable eyes which securely connect the ends of the cable with one another, wherein the cable forms a closed ring.

A disadvantage in this solution is that, as a result of sudden loading, for example, due to tearing of the primary suspension means, the redundant suspension also tears or at least damages the cables of the redundant suspension by the cable clamps.

SUMMARY OF THE INVENTION

It is the object of the invention to provide a cable connection as a redundant suspension for a running rail in which the above-mentioned disadvantages are avoided.

According to the invention, this object is met by providing a connection element for the cable ends having two wedge locks. The invention provides that the ends of the cable are detachably connected with one another by the connection element. The wedge locks are connected to one another to form a constructional unit and are arranged such that one wedge lock is rotated by 180 degrees relative to the other wedge lock, so that the ends of the cable which run in from opposite directions can be guided back in the direction opposite to their running-in direction after deflection around the wedges of the wedge locks such that they can be clamped by the wedges, at least under load. The working directions of the wedges clamping the ends of the cable are opposed to one another. In this way, the cable is tightened against the friction resistance of the wedge lock during sudden loading, wherein it is heated and absorbs the suddenly occurring kinetic energy.

An advantageous construction of the connection element is provided in that each wedge lock is formed of a base plate and a pocket formed thereon with a wedge-shaped space for receiving the corresponding wedge which is insertable therein.

The wedge is freely displaceable in the running-in direction, so that the cable can be disconnected in a simple manner in the unloaded state.

The connection element is constructed in a simple manner in that it is formed of two wedge locks having a common base plate.

Each end of the cable includes a cable clamp to prevent the cable from sliding out of the connection block.

For effective absorption of kinetic energy during sudden loading, it is suggested that the wedge angle lies within an angular range of 10 degrees to 14 degrees.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements.

DETAILED DESCRIPTION OF THE PRESENTLY PREFERRED EMBODIMENTS

Figure 1:
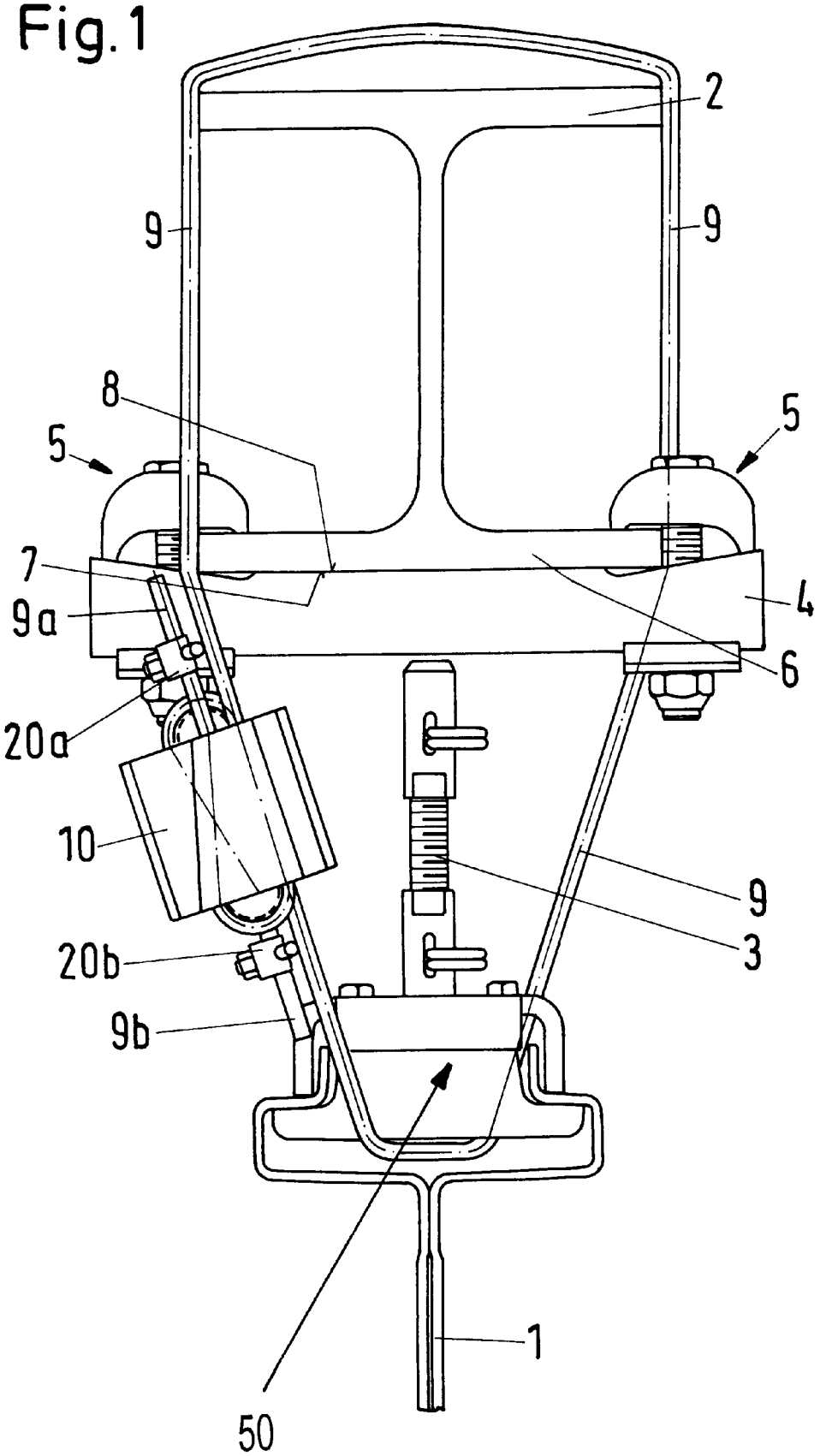
FIG. 1 shows a cross section through a girder with an embodiment of a redundant suspension according to the invention.
Figure 2:
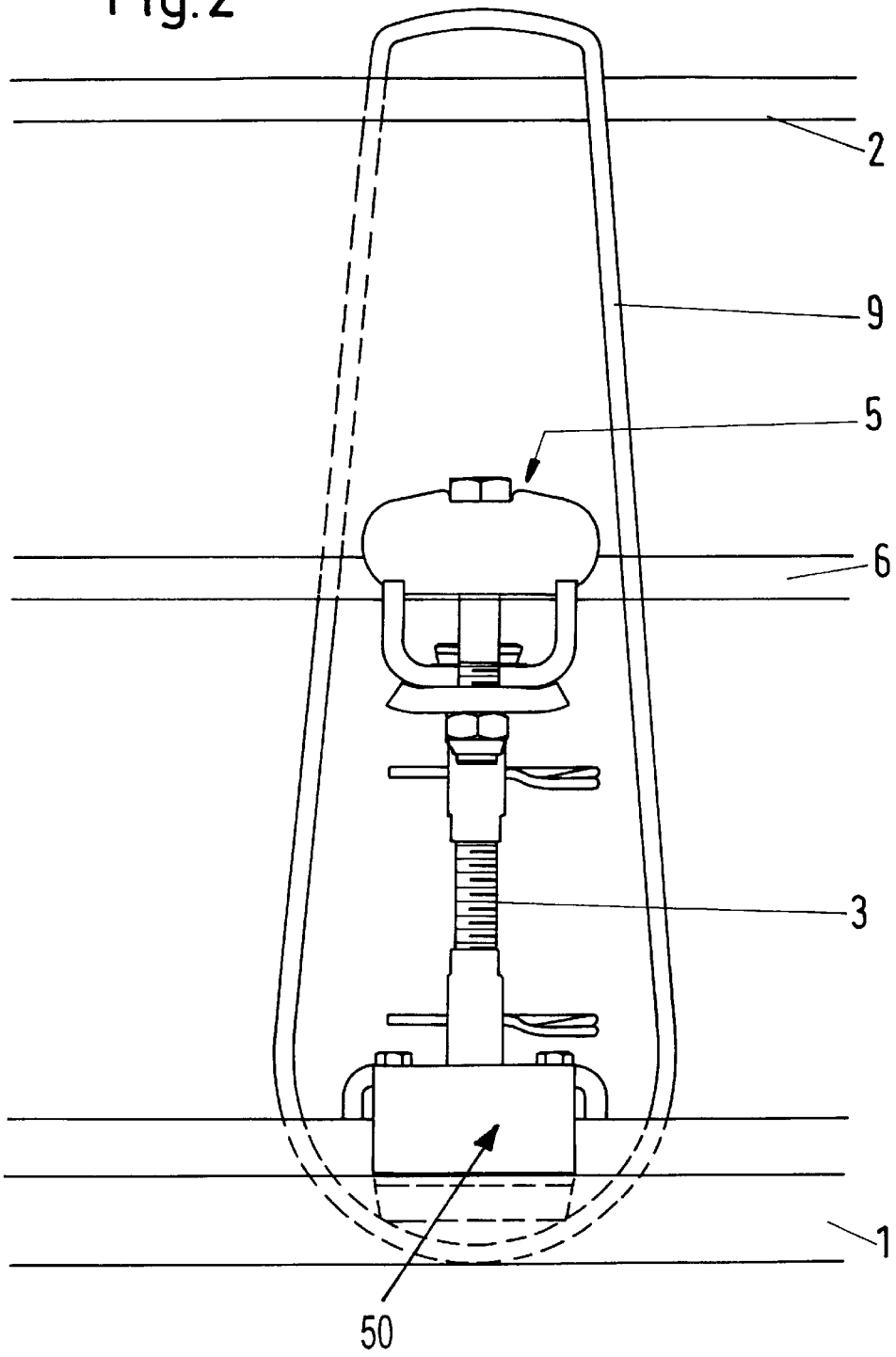
FIG. 2 is a front view of the redundant suspension from the side of the girder of FIG. 1.

Referring initially to FIGS. 1 and 2, a suspension 50 for a suspending running rail 1 from a girder 2 includes a pin or bolt 3. A top of the bolt 3 is connected with a transverse beam 4 so that the bolt 3 is swivelable within a small angular range. The transverse beam 4 is securely connected to a bottom flange 6 of the girder 2 by a screw connection 5. The girder 2 is I-beam shaped in the embodiment shown in FIG. 1. However, any shaped girder 2 may be used. An upper contact surface 7 of the transverse beam 4 contacts the bottom outer surface 8 of the bottom flange 6 under the application of force. As can further be seen from FIG. 1, a lower end of the bolt 3 is securely connected with the running rail 1 so that the bolt 3 is also swivelable within a defined angular range.

FIG. 1 also shows a cable 9 provided in addition to the suspension 50 with the bolt 3. The girder 2 and the running rail 1 are connected with one another by the cable 9. For this purpose, the cable 9 is wrapped around the girder 2 and is guided through the suspension 50 of the running rail 1. Ends 9*a* and 9*b* of the cable 9 are securely connected with one another, so that the cable 9 forms a closed ring which takes over the holding of the running rail 1 at the girder 2 in the event of a failure of the suspension 50.

Figure 3:
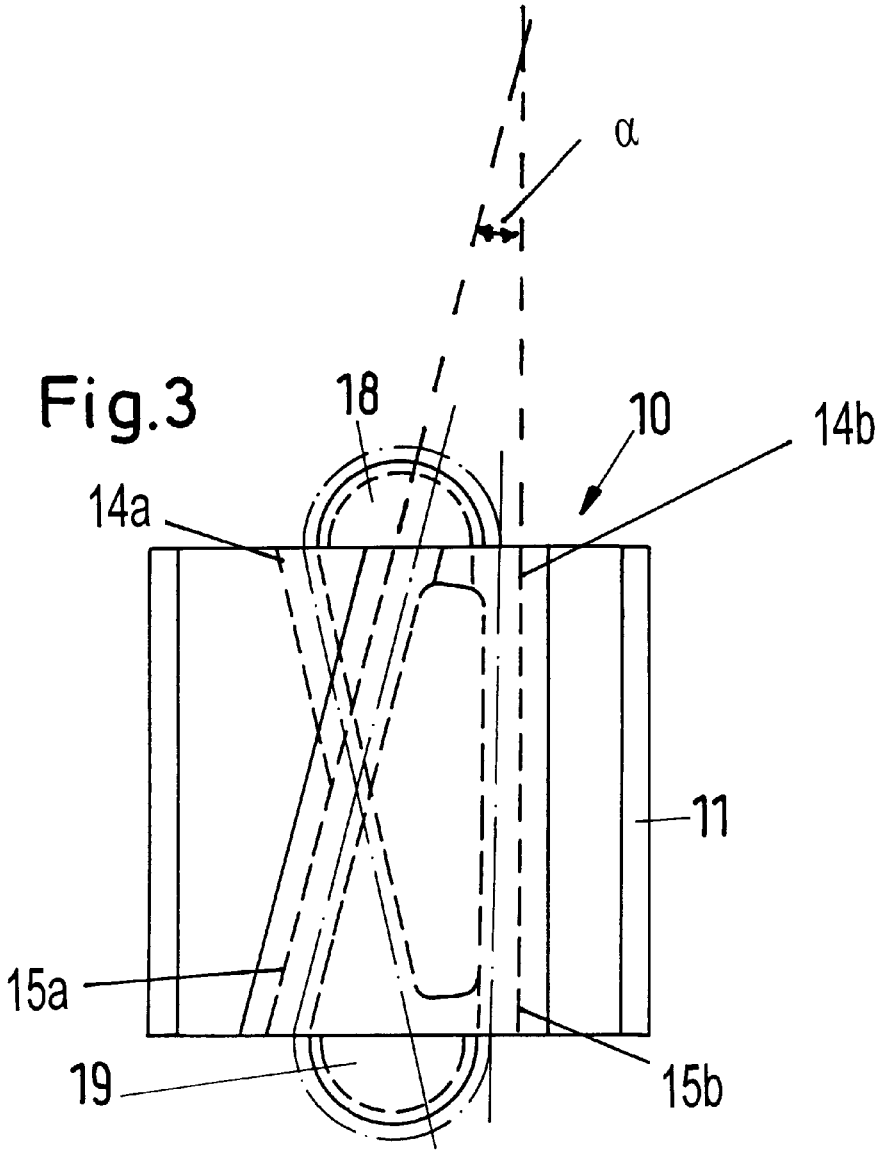
FIG. 3 is a front view of a connection element of the redundant suspension shown in FIGS. 1 and 2.
Figure 4:
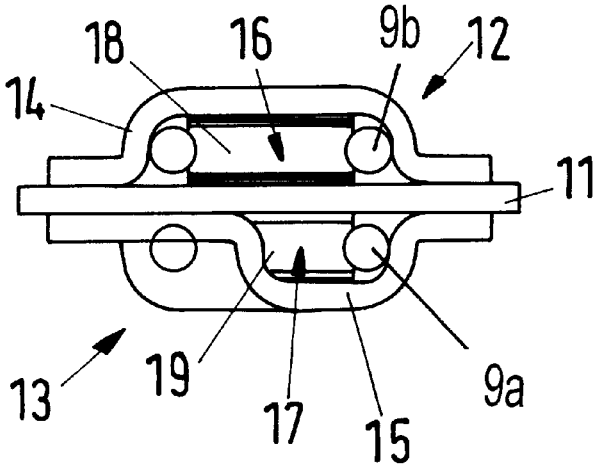
FIG. 4 is a top view of the connection element of FIG. 3, with the steel cables guided therein shown in cross section.

The ends 9*a*, 9*b* of the cable are securely connected with one another by a connection element 10. Referring to FIGS. 3 and 4, the connection element 10 includes a base plate 11 which carries a pair of wedge locks 12 and 13, one on each side of a base plate 11. The wedge locks 12 and 13 are accordingly connected with one another simultaneously via the base plate 11. Each of the wedge locks 12 and 13 includes a pocket piece 14 and 15 connected to the common base plate 11. The pocket pieces 14 and 15 are formed, for example, from sheet metal. The wedge locks 12 and 13 are rotated by 180 degrees relative to one another. The top view of the connection element 10 of FIG. 4 shows a first opening 16 of the wedge lock 12 and a second opening 17 of the wedge lock 13. The interior of each of the pocket pieces 14 and 15 is wedge-shaped and has two lateral surfaces 14*a* and 14*b* in pocket piece 14 and 15*a* and 15*b* in pocket piece 15, which taper toward one another. In an imaginary extension of the two lateral surfaces, an acute angle, i.e., the wedge angle cat (FIG. 3), is formed which corresponds 14 degrees in the embodiment example. The wedge angle a may include angles from 10 to 16 degrees.

Correspondingly shaped wedges 18 and 19 having essentially the same wedge angle are introduced into the pocket pieces 14 and 15 from one side, respectively. As shown in FIG. 3, the ends 9*a* and 9*b* of the cable 9 run into the wedge-shaped pocket pieces from opposite directions. The end 9*a* is guided into pocket piece 15 and around wedge 19 and the end 9*b* is guided into pocket piece 14 and around wedge 18. The wedges 18 and 19 are freely displaceable at least in the running-in direction.

Portions of the cable 9 contact the wedge 18 and 19 and inner surfaces of the pocket, respectively, transverse to its longitudinal direction on both sides of its outer circumference. After deflection around the wedges 18, 19 of the wedge locks 12, 13, the cable ends 9*a* and 9*b* are guided back opposite to their running-in directions. Thus, the working directions of the wedges 18, 19 clamping the ends 9*a*, 9*b* of the cable are oppositely directed. As is shown in FIG. 1, cable clamps 20*a*, 20*b* are provided for securing the ends 9*a*, 9*b* of the cable.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

The invention is not limited by the embodiments described above which are presented as examples only but can be modified in various ways within the scope of protection defined by the appended patent claims.

We claim:

1. A suspension for suspending a running rail of a lifting mechanism from a girder, comprising:

a cable connecting said girder and said running rail and having a first end and a second end; and a connecting element comprising a base plate having two opposing planar sides and two wedge locks respectively arranged parallel to each other on said opposing planar sides of said base plate, wherein each said two wedge locks comprising a wedge pocket and a wedge piece inserted therein, said wedge piece having a working direction, each said first and second ends of said cable entering one said two wedge locks in a run-in direction, being wrapped around said wedge piece and exiting said one said two wedge locks in a direction opposing said run-in direction such that said first and second ends of said cable are clamped by said wedge pieces under load, and wherein said two wedge locks are rotated relative to each other so that said working direction of each said wedge pieces substantially opposes the other said wedge pieces.

2. The suspension of claim 1, wherein said wedge piece is freely displaceable in said one said two wedge locks in said working direction.

3. The suspension of claim 1, further comprising a cable clamp connected at each said first and second cable ends thereby preventing said cable from sliding out of said wedge lock.

4. The suspension of claim 1, wherein an angle of said wedge piece lies within an angular range of 10 degrees to 16 degrees.

* * * * *